United States Patent [19]

Rauch

[11] Patent Number: 4,610,045

[45] Date of Patent: Sep. 9, 1986

[54] TOOTHBRUSH

[76] Inventor: Samuel Rauch, 40 Spruce St., Cedarhurst, N.Y. 11516

[21] Appl. No.: 630,062

[22] Filed: Jul. 12, 1984

Related U.S. Application Data

[63] Continuation-in-part of Ser. No. 370,460, Apr. 11, 1982, Pat. No. 4,472,853.

[51] Int. Cl.[4] ..... A46B 9/04

[52] U.S. Cl. ..... 15/167 R; 15/110; 15/201; 15/DIG. 5; 15/DIG. 6

[58] Field of Search ..... 15/201, 110, 167 R, 15/167 A, 172, 176, DIG. 5, DIG. 6

[56] References Cited

U.S. PATENT DOCUMENTS

| | | | |
|---|---|---|---|
| 4,010,509 | 3/1977 | Huish | 15/167 R |
| 4,288,883 | 9/1981 | Dolinsky | 15/110 |
| 4,472,853 | 9/1984 | Rauch | 15/167 R |

*Primary Examiner*—Peter Feldman

*Attorney, Agent, or Firm*—Kane, Dalsimer, Kane, Sullivan and Kurucz

[57] ABSTRACT

The present invention is a toothbrush provided with a teeth brushing surface and two gum treatment brush surfaces which distributes the brushforce to optimally and automatically clean the tooth surfaces, clean under the sulcus and massage the gums during casual horizontal brushing. The gum treatment brush surfaces can be integral with the tooth portion or disposed on an outrigger brush body that may be attached to a conventional toothbrush or one specially adapted for that purpose.

25 Claims, 22 Drawing Figures

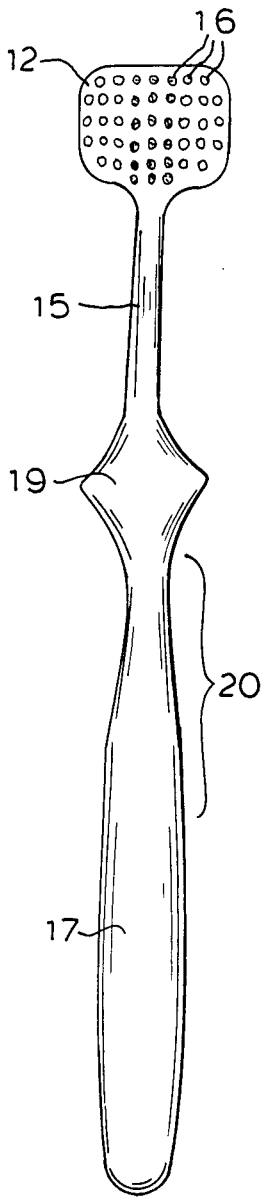
FIG.1
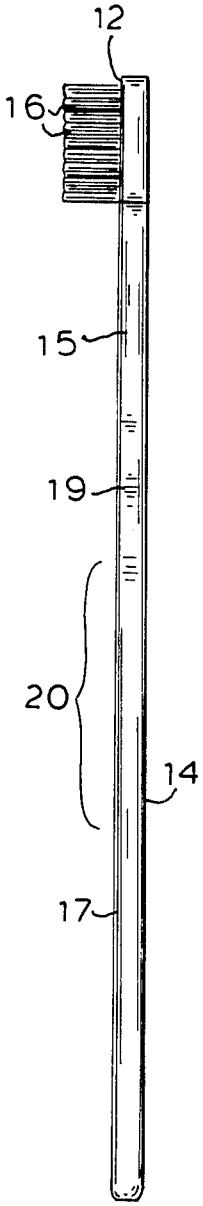
FIG.2
FIG.1B
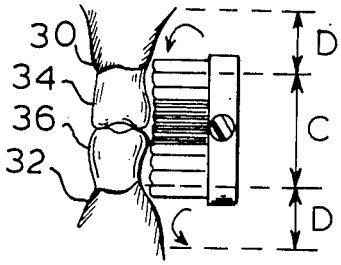
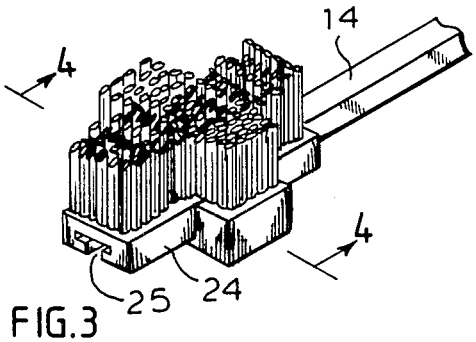
FIG.3
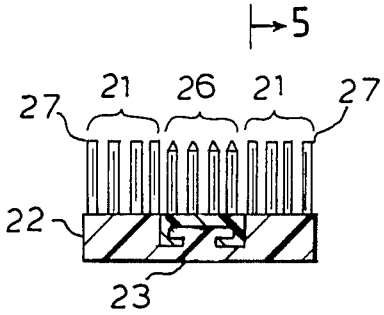
FIG.4

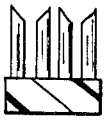
FIG. 5
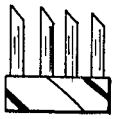
FIG. 6
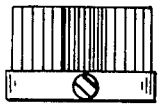
FIG. 7
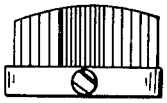
FIG. 8
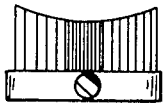
FIG. 9
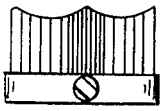
FIG. 10
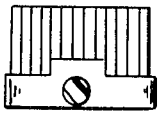
FIG. 12
FIG. 13
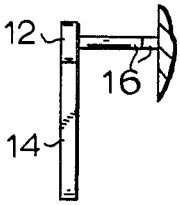
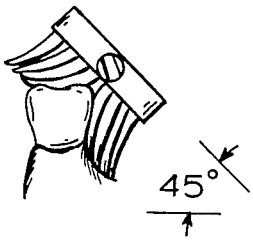
FIG. 11
FIG. 14
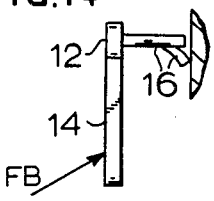
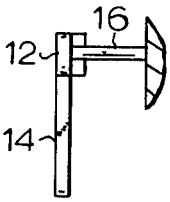
FIG. 17
FIG. 15
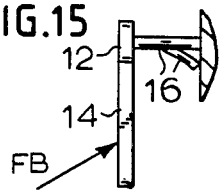
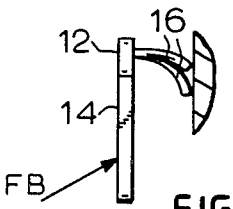
FIG. 16
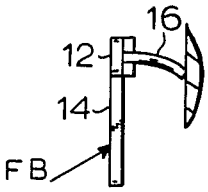
FIG. 18

TOOTHBRUSH

This application is a continuation-in-part of applicant's copending U.S. patent application Ser. No. 370,460 filed Apr. 11, 1982, now U.S. Pat. No. 4,472,853.

FIELD OF THE INVENTION

The invention relates to a new and improved toothbrush. More specifically, a toothbrush having a brushing surface widened and shortened in length so when it is used in a casual conventional manner it results in automatic cleaning of teeth, removal of debris and bacteria from under the sulcus at the gumline and massage and stimulation of the gum. It is in reality, a mouthbrush rather than a toothbrush. It processes the mouth rather than brushes the teeth alone.

BACKGROUND OF THE INVENTION

Tooth decay caused by the effect of plaque and bacteria on tooth enamel is steadily being reduced as the prime cause of tooth loss. Fluorides put in drinking water or topically applied as well as new synthetic coatings to be applied to the teeth have respectively toughened the enamel to resist decay and shielded the enamel so that in the very near future decay will not occur on the enamel surfaces. Brushing the teeth as it is presently done to remove plaque and bacteria will not be necessary to prevent decay. Brushing of the enamel surfaces will only be done to gain a general feeling of cleanliness of the teeth and mouth. The focus of proper dental care will shift to the prevention of periodontal disease and to the gum and to bacteria under the sulcus where the root surface is vulnerable to decay because it is not protected by enamel. Gums will have to be massaged to suffuse them with blood to keep them from receding. Bacteria will have to be removed from this unprotected area as well as from under the sulcus. The importance of addressing the gum for proper dental care was first taught by U.S. Pat. No. 2,845,649 which discloses the idea of soft toothbrush bristles and the importance of gum massage in oral health care. Until relatively recently, up and down brushing, i.e., vertical stroking, was the preferred and most widely recommended dental cleaning technique to clean the enameled surfaces. When this method is used with a conventional toothbrush, the gums are inadvertently massaged (stimulated) as the brushing surface passes beyond the upper and lower gumlines. This gum massage should stimulate the gums and should be beneficial for gum health. However, it was found that this vertical stroking pushed the gum away from teeth and forced food into the space between the teeth and gums thus contributing to periodontal disease and to cavities below the gum line. Such damage to the gums and teeth can be eliminated by brushing with a toothbrush having soft bristles with rounded ends and by using a motion that is primarily back and forth, i.e., a horizontal stroking technique. Consequently, horizontal stroking is now the preferred dental cleaning technique.

A shortcoming of horizontal stroking with a conventional toothbrush is that unless the user is schooled in the proper use of the brush and uses it in that way, proper cleaning and stimulation of the gums will not be accomplished. In other words, casual horizontal brushing with conventional toothbrushes does not result in properly stimulated gums and thus this very critical part of good dental hygiene is lost. This is particularly harmful to the gums and teeth in the buccal corridor, that is, in the space between the cheek, gums and teeth, because this area is not ordinarily stimulated by normal eating and chewing.

Another shortcoming of conventional toothbrush design is that it fails to encourage proper brushing technique as illustrated by the Bass (Stillman) toothbrushing technique which requires the bristles to be angled at 45° toward the gumline. A current textbook describing this technique is *Glickman's Clinical Periodontology—Ferman A. Carranza Jr. Dr. Odont*—5th edition, 1979, pages 729–738. Unless the bristles are consciously angled toward the gumline, the area under the sulcus on the tooth root will not be swept clean of bacteria, a basic cause of tooth decay and periodontal disease.

Another shortcoming of the conventional toothbrush is that the soft bristles suitable for gum contact are less effective for cleaning the hard tooth surfaces and if one pushes hard to get a better cleaning action, it splays the bristles and results in a reduction in the overall effectiveness of all brushing action.

SUMMARY OF THE INVENTION

It is an object of the present invention to provide a toothbrush that, with casual horizontal brushing, will automatically position itself to effectively clean teeth, clean under the sulcus and simultaneously clean and stimulate the gum.

Another object of the present invention is to provide a toothbrush that distributes the force applied to the handle by the user so that a higher brush pressure is applied to the teeth to effectively clean them and remove plaque while simultaneously applying a lesser pressure to the gums to clean and massage them without causing damage to them.

Another object of the present invention is to provide a toothbrush that by its shape forces a basic horizontal brushing technique and if used vertically will not damage the gums.

Another object of the present invention is to provide a toothbrush having bristles of selected flexibility, length or density for distributing the brushing force applied to the handle between the gums, teeth and gumline areas during horizontal brushing so that each area is processed automatically in an optimum manner.

The present invention provides a wide brushing surface for simultaneous contact with a user's upper gums, teeth and lower gums, while advantageously distributing brushing forces between teeth and gums. Its width requires the use of a predominantly horizontal stroking technique and its short length results in a brush size that is practical to put in one's mouth. Use of the wide head when brushing either upper or lower teeth alone (mouth open) requires that one press the brush head into the buccal area, thus forcing simultaneous brushing of both teeth and gums which causes a rotational moment about the handle axis and results in the bristles angling themselves at 45° to the gumline which sweeps the debris from under the sulcus. This 45° position is part of the well known Bass (Stillman) toothbrushing technique described in texts on periodontal dentistry. The dimensions of the brush head and handle are critical for the design of a toothbrush to function, as previously described. The width of the tooth and gum portions must be controlled so that they predominantly contact the surfaces that they were designed for during casual brushing. The length, width and depth of the brush head and the portion of the handle that enters the mouth (the bristles must be shortened and the handle narrowed) must also be controlled so that the total volume of the brush that is inserted in the mouth must be similar to the comparable volume of a conventional toothbrush, so as not to feel uncomfortably large in the user's mouth. The typical toothbrush user has been conditioned to accept a certain feel and volume in the mouth and a substantial deviation from this will prevent its acceptance regardless of its other benefits. Small distances on foreign objects put in the mouth are magnified by physiological factors and are extremely critical in the final brush head design.

Another important advantage of the widened brush shape of the present invention is that it would facilitate the simultaneous and selective application of more than one dentifrice, medication or the like to specific areas of the user's mouth, (teeth, gums and gumline) during normal brushing.

These and other objects and advantages of the present invention will be apparent from the following description and by reference to the accompanying drawings wherein:

FIG. 1 is a top plan view of a toothbrush constructed in accordance with the present invention.

FIG. 1B is a cross-sectional side view of the brush head shown in FIG. 1 as it would appear in a user's mouth with respect to teeth and gums.

FIG. 2 is a side view of the toothbrush constructed in accordance with the present invention shown in FIG. 1.

FIG. 3 is an isometric view of an alternative embodiment of the present invention.

FIG. 4 is a cross-sectional view of the alternative embodiment of the present invention shown in FIG. 3.

FIGS. 5 and 6 are cross-sectional views of alternative embodiments illustrating tuft designs useful with the present invention.

FIGS. 7, 8, 9 and 10 show alternate brush surface curvatures, flat, convex, concave, double concave respectively; a feature that could be selected to make a brush more suitable for a particular user.

FIG. 11 shows the equilibrium position where the bristles are 45° to the gumline (The Bass (Stillman) position).

FIG. 12 shows an alternate design whose brush surface is flat but where bristle length between tooth and gum portions is varied by stepping the brush body.

FIGS. 13, 14, 15 and 16 show sequentially how the brush force applied to the handle gets distributed to the teeth and gum by the long and short bristles whose ends are not in the same plane parallel to the brush body.

FIGS. 17 and 18 show how the brush force gets applied to the teeth and gums when the brush body is stepped as in FIG. 12 and both long and short bristle ends are in the same plane parallel to the brush body.

DETAILED DESCRIPTION OF PREFERRED EMBODIMENTS

Figure 19:
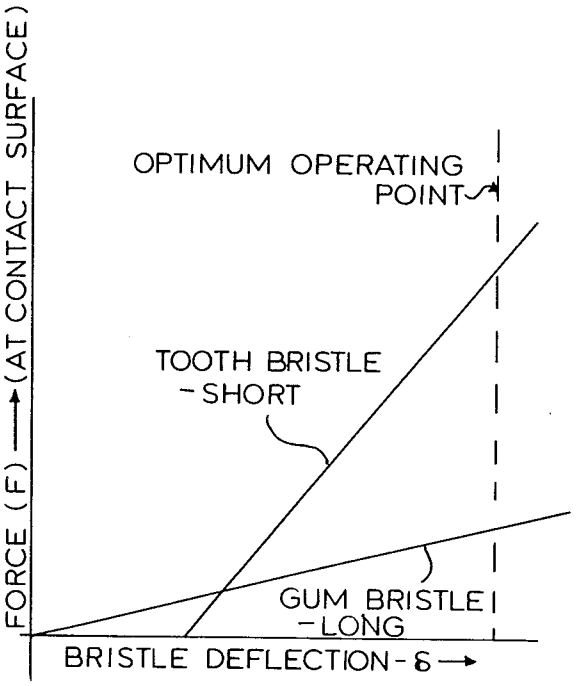
FIG. 19 shows the force (f) vs deflection (δ) curve for the bristles when the gum bristles are longer than the tooth bristles.

Throughout the drawings the same reference numerals refer to the same elements.

The brushing forces transmitted through the brush handle 14 to teeth and gums by the brushing surface may be controlled and selectively distributed by varying the size, shape, flexibility and arrangement of the bristles 16, as hereinafter described, to optimize their massage functions so that the tooth bristles clean the teeth and gum bristles clean under the sulcus and massage the gums without damaging them.

Tufts may be made more flexible by tapering individual bristles or varying their diameter or composition, or staggering their height, etc. Accordingly, bristles 16 are arranged on the brush body 12 and sized and spaced so that the portions of the brushing surface that primarily contact the gums during horizontal brushing, i.e., gum areas D are more flexible or apply less brushing pressure than that portion of the brushing surface that simultaneously contacts the teeth, i.e., area C (Figure 1B). The width of teeth cleaning portion within area C is parallel to that of the brush body 12 and brushing surface and is preferably 3/16 to ¼ inch or 3 or 4 rows in a typical toothbrush design. However, its width might be as little as 1/16 to 3/16 inch (1 to 3 rows). The tooth portion width is selected so that when the brush head is moved horizontally during use, vertical displacement resulting from the normal tolerance on horizontal stroking does not result in substantial contact of the tooth bristles with the more sensitive gum tissue.

Figure 20:
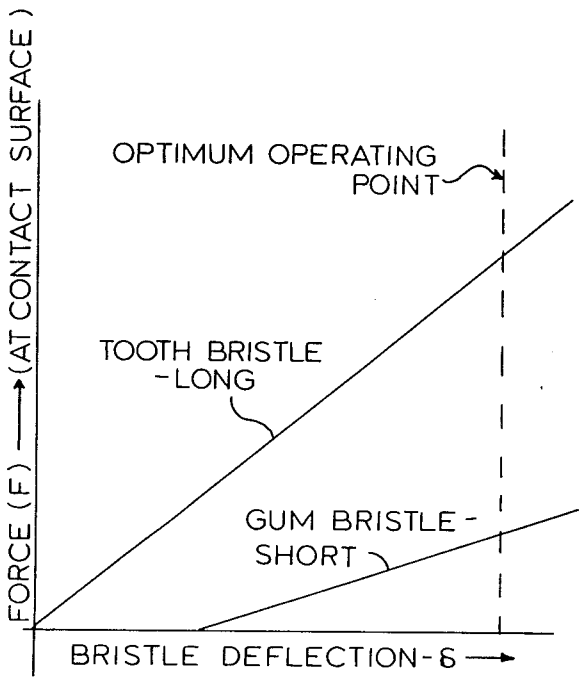
FIG. 20 shows the force (F) vs deflection (δ) curve for the bristles when the tooth bristles are longer than the gum bristles.

Softer bristles, which reduce brushing pressure in the gum stimulating area D, may also be provided by stepping or curving down the brush body 12 so that the gum stimulating area D bristles are longer, therefore more flexible than those in the teeth area C. Likewise, substituting a softer more flexible typical bristle material for the gum area D bristles will have a similar result. Elastomer could be used for the gum portion. Other means for achieving less brushing force in the gum area D, involves a brush body with flexible members or segments which permits the bristles in the gum stimulating area D, that is, those bristles 16 projecting from brush body segments to retract when force is applied to their ends. The flexing members need not connect brush body segments to the brush body but may alternatively connect brush body segment to the elongated handle 14. The foregoing means for controlling the brushing force distribution are more fully described in my copending U.S. patent application Ser. No. 370,460 filed Apr. 21, 1982. For optimum brush performance the design of the brush must be such that less pressure is applied to the gum than to the teeth or conversely more brush pressure must be applied to the teeth than to the gum. This can be done by varying bristle length, diameter, cross section, material (modulus of elasticity) or end configuration thus making different tooth or gum portions. The effect of varying bristle diameter, cross section, material and end configuration on pressure are fairly obvious. The effect of varying bristle length is not that obvious and depends on the overall design and the other design factors. FIGS. 13–21 are included to show how the brush force (FB) applied to the handle by the user is distributed to the teeth and gum by the deflecting bristles to apply the optimum pressure to each surface. For clarity the illustrations show a brush head with one long and one short bristle but the same functional logic would apply to tufts of bristles or to a field of tufts. FIG. 13 shows a brush with a long and short bristle. FIGS. 14, 15 and 16 show the bristle deflection as first the long bristle contacts the surface, then the short bristle just comes into contact and finally when both the long and short bristle are in contact and are applying pressure. The force, FB applied to the handle as shown transfers to the bristles and resolves itself into horizontal and vertical force components at the bristle ends which creates the pressure on the teeth and gums. FIG. 19 shows the resulting force-deflection curve if the two bristle brush of the brush was designed with the long bristles contacting the gum and the short bristles contacting the teeth. The indicated optimum operating point must be reached where there is greater tooth pressure than gum pressure. FIG. 20 is the force deflection curve for a design where the tooth bristles are made longer than those in the gum portion. The optimum operating point also indicates a higher tooth pressure than gum pressure.

Figure 21:
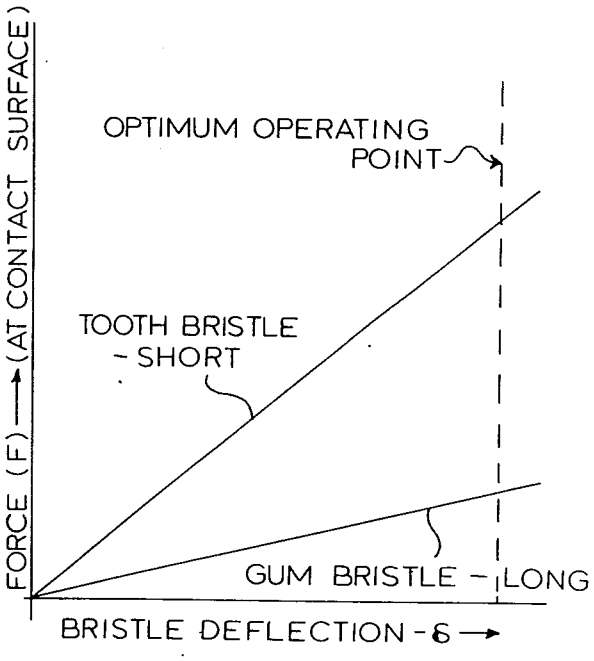
FIG. 21 shows the force (F) vs deflection (δ) curve for the bristles when both long and short bristle ends are in the same plane parallel to the stepped brush body.

These curves illustrate that optimized designs with gum bristles longer than tooth bristles (FIG. 9 or FIG. 10) or with tooth bristles longer than gum bristles (FIG. 8), applied with equal brush force resulting in equal bristle deflection, will require variations in design parameters other than bristle length in order to reach the same optimum pressure operating point. The fact is conveyed by observing that the tooth bristle curves in FIGS. 19 and 20 have different slopes. The same is true for the slopes of the gum bristles in FIGS. 19 and 20. FIG. 21 is the force deflection diagram of a stepped body design, an alternate configuration where deflection for both long and short bristles are equal and start at initial contact. Comparing FIGS. 19 and 21 support the same logic about design parameters by illustrating that the tooth bristle slopes are different.

In all embodiments, the general brush shape, i.e., wider than it is long, will prevent gum tissue and tooth damage caused when vertical brushing is employed. Straight up and down brushing cannot be done because the brush body 12 and brushing surface are too wide when upper and lower teeth are in contact and will tend to rotate to 45° if used on either upper or lower teeth. However, as shown by the arrows in FIG. 1B, the brush handle may be rotated, causing the bristles to pass over the upper gumline 30 and teeth 34, 36 in a vertical path. Unlike a narrow, conventional brush used in a like manner, the wide shape will prevent the lower bristles from touching and damaging the lower gumline 32 tissue while the upper bristles are bent during rotation. Similarly, the upper gumline 30 tissue will not be damaged when the lower gums are vertically massaged in this fashion by rotating the brush in the opposite direction.

Referring specifically to the drawing, FIG. 1 shows a preferred embodiment wherein the brush body 12 has an elongated handle 14 and a plurality of bristles 16 that project outwardly. The widest portion of the brush body 12 is approximately perpendicular to the longitudinal axis of the elongated handle 14. The brush body 12 width may be up to 3 times its length, preferably 1.25 times its length.

It is contemplated that the teethbrushing portion is from about 1/16 to ¼ inch wide and each gum brushing portion is from about 11/32 inch to 14/32 inch wide, the tooth portion being less in width of each gum brushing portion and all widths selected so that the overall width of the brush head is about 15/16 inch; the total volume of the toothbrush body, handle and bristle envelope that enter the mouth is approximately 0.58 cu. inc., the approximate volumns of one of the largest commercially available toothbrushes. The bristles 16 taken collectively comprise the brushing surface. The brushing surface is the portion of the brush that actually contacts the user's gums and teeth for cleaning and stimulating purposes.

The brushing surface width is greater than the greatest distance between the potential user's upper 30 and lower 32 gumlines with teeth 34, 36 closed. Therefore, when the brush is placed adjacent to the closed teeth 34, 36 as shown in FIG. 1B, and moved in a horizontal path, the upper gums, teeth and lower gums are cleaned and stimulated simultaneously.

If any attempt were made to brush either upper or lower teeth with a horizontal motion and not simultaneously contact the associated gums, forces applied through the handle acting through a moment arm having a fulcrum coinciding with the handle axis would tend to make the brush slip off the teeth. Thus, the net effect of the brush geometry will make the user push the brush into the buccal area causing a brush rotation and an equilibrium position where simultaneous brushing of teeth and gum is achieved (FIG. 11).

Another feature that may be incorporated into the toothbrush shown in FIG. 1 is a means for damping the overall pressure or force of the brushing surface upon the teeth and gums by providing a weakened flexing section 15 between the brush body 12 and the gripping portion of the handle 17. When a user applies excess force to the brush handle, the weakened flexing section 15 bends, thereby damping the overall pressure or force and indicates to the user to let up thus avoiding damage to the gums. This narrowing at 15 also has the advantage of reducing the volume that is put in the user's mouth thus making its use comfortable and thereby making it more acceptable.

As shown in FIG. 2, the brush handle 14 may be substantially straight when viewed from the side. This enhances brushing control and permits use of this brush with conventional toothbrush containers including display racks and other marketing devices. A widened shoulder 19 may also be provided so that this toothbrush will sit in a more upright, attractive position in standard toothbrush holders. The gripping portion of the handle 14 may be provided with rounded edges 20 so that it slips in the user's hand thereby facilitating the preferred 45° brush position discussed in previous paragraphs.

FIGS. 3 and 4 illustrate an embodiment of the invention wherein the gum massaging portions 21 and 21' of the brushing surface are formed on a separate member 22 having a channel 23 therein for engaging a cooperating structure 25 provided for that purpose on brushing head 24, sometimes referred to as an "outrigger" as in the above-described embodiments. The gum massaging portions 21 and 21' are designed to cooperate with teeth cleaning portion 26 so that the desired distribution of brushing forces is achieved, i.e., higher pressure on the teeth than on gums.

It will be appreciated that the removable member 22 could be adapted to engage conventional toothbrushes either removably or permanently, e.g. glued. Although the preferred shape, i.e., a brushing surface that is wider than it is long, may be lost when the removable member 22 is used with a conventional toothbrush shape as shown in FIG. 3, many of the features and advantages of the invention are retained.

As shown in FIGS. 4, 5 and 6 the tuft ends 27, which form the brushing surface are designed so that those that contact the gum, e.g. 21 and 21', are rounded and have smooth edges so that they are gentle on the gums during brushing while those tuft ends that contact the teeth, e.g. 26, may have sharp jagged edges suited to removing plaque from hard tooth surfaces.

Another advantage of toothbrushes designed in accordance with the foregoing disclosure is that when they are held loosely in the user's hand and with a horizontal stroke to brush the inner or outer surface of either the upper or lower teeth alone, the bristles of the brush will automatically orientate themselves at about a 45° angle with the tooth surface due to an unbalance of force at the brush head. This is the recommended attitude for the bristles for cleaning plaque and debris from under the sulcus during horizontal brushing and is part of the Bass (Stillman) toothbrushing technique described in periodontal dental texts.

FIGS. 7, 8, 9 and 10 show alternate contours of the brushing surface looking in the direction of the brush handle axis. One of the four shown (flat, convex, concave, double concave) would be optimum for an individual user. This determination would best be made by a dental care professional, preferably a dentist. A customized version (a modification of one of the four basic surfaces) tailored to an individual's mouth could be made by the dentist who would cut and polish the bristles with tools and techniques supplied by the manufacturer. Barring the selection by a dental care professional, the convex surface would be the preferred embodiment for the average person.

While in order to comply with the statutes, the present invention has been described in specific terms, it is to be understood that the invention is not limited to the specific embodiments disclosed herein and that the invention is therefore claimed in any of its forms, modifications, or equivalents within the legitimate and valid scope of the appended claims.

What is claimed is:

1. An improved toothbrush for cleaning teeth and automatic and simultaneously cleaning under the sulcus and cleaning, massaging and stimulation the gums which comprises:

a first brush body;

an elongated handle extending from the first brush body;

a plurality of bristles having ends projecting from the first brush body defining a teeth brushing surface;

an outrigger comprising a second brush body;

a plurality of bristles having first ends embedded in the second brush body and second ends projecting therefrom defining gum treatment brush surface fitting on both sides of the tooth brushing surface, the relationship of the bristle ends are such that the teeth brushing surface primarily contacts the teeth and the gum treatment brush surface primarily contacts the gum tissue during horizontal brushing, the gum treatment brush surface being adapted to apply less brushing pressure on gums than the teeth brushing surface applies to the teeth: the difference in brushing pressure being accomplished for each surface by varying at least one of bristle length, diameter, spacing, cross section, material and end configuration and the brush head being of a sufficient width so that the first and second brush bodies cooperate with the elongated handle to provide an overturning moment when the upper or lower teeth are brushed requiring the user to push the brushing surfaces into the buccal corridor and causing a rotation of the brush body about the handle axis to approximately 45° which results in cleaning under the sulcus in the Bass (Stillman) toothbrushing technique.

2. The improved toothbrush recited in claim 1 wherein the outrigger is integral with the first brush body.

3. The improved toothbrush recited in claim 1, wherein the outrigger is removable.

4. The improved toothbrush recited in claims 2 or 3 wherein the combined width of the brush bodies is wider than it is long.

5. The improved toothbrush recited in claim 4 wherein the width is slightly longer than its length to 3 times its length.

6. The improved toothbrush recited in claim 5 wherein the preferred width being 1.25 times its length.

7. The improved toothbrush recited in claim 6 wherein the gum treatment brush surface have a combined width sufficient to simultaneously contact a user's upper gums, teeth and lower gums.

8. The improved toothbrush recited in claim 7 wherein the teethbrushing portion is from about 1/16 to $\frac{1}{4}$ inch wide and each gum brushing portion being from about 11/32 inch to 14/32 inch wide, the tooth portion being less in width of each gum brushing portion and all widths selected so that the overall width of the brush head is about 15/16 inch.

9. The improved toothbrush recited in claim 7 where the combined brush surface is flat.

10. The improved toothbrush recited in claim 7 where the combined brush surface is concave or stepped to approximate concavity.

11. The improved toothbrush recited in claim 7 where the combined brush surface is convex or is stepped to approximate this shape.

12. The improved toothbrush recited in claim 7 where the combined brush surface is double concave or is stepped to approximate this shape.

13. The improved toothbrush recited in claim 7 wherein the combined brush surface possesses a contour unique to an individual and is shaped to fit the individual user's teeth and gums, having an initial configuration selected from continuous or stepped shapes including flat, convex, concave, or double concave.

14. The improved toothbrush recited in claim 1 where bristle and tuft length are equal to or less than approximately $\frac{3}{8}$ inch, the length of the tufts and bristles on toothbrushes currently marketed for children.

15. The improved toothbrush recited in claim 1 where the bristles define an evelope, the total volume of the toothbrush body, handle and bristle envelope that enter the mouth is approximately 0.58 cu. in.

16. The improved toothbrush recited in claim 1 wherein the bristles define an envelope, the first and second brush body and bristle envelope are shaped so that the bristles comprising the gum treatment brush surface are longer and more flexible than those comprising the teeth brushing surface, while the brushing surface is flat or otherwise.

17. The improved toothbrush recited in claim 1 wherein the bristles comprising the gum treatment brush surface are fabricated from more flexible standard bristle material, one with smaller modulus of elasticity, than those comprising the teeth brushing surface.

18. The improved toothbrush recited in claim 1 wherein the bristles comprising the gum treatment brush surface are smaller in diameter and more flexible than those comprising the teeth brushing surface.

19. The improved toothbrush recited in claim 1 wherein the bristles comprising the gum treatment brushing surface are tapered and more flexible than those comprising the teeth brushing surface.

20. The improved toothbrush recited in claim 1 wherein the bristles of the tooth portion are made from natural bristles and the bristles of the gum portions are made from synthetic bristle material.

21. The improved toothbrush recited in claim 1 wherein the bristles comprising the gum treatment brush surface and the teeth brushing surface are arranged in tufts.

22. The improved toothbrush recited in claim 1 wherein the tufts in the gum treatment brush surface are composed of bristles of variable length so that they are more flexible than those tufts comprising the teeth brushing surface.

23. The improved toothbrush recited in claim 1 wherein there are fewer tufts, or greater tuft spacing, comprising the gum treatment brush surface than the teeth brushing surface.

24. The improved toothbrush recited in claim 1 wherein sharp edges are removed from the bristle ends comprising the gum treatment brush surface so that they are gentle on the gums by reducing the pressure on the gum and sharp edges are left or provided on the bristles comprising the teeth brushing surface to facilitate the removal of plaque and other debris from hard tooth surfaces by increasing the pressure on the teeth.

25. The improved toothbrush recited in claim 1 wherein the outrigger is adapted to engagement with a conventional toothbrush.

* * * * *